US009153206B2

(12) United States Patent
Kim et al.

(10) Patent No.: US 9,153,206 B2
(45) Date of Patent: Oct. 6, 2015

(54) METHOD AND APPARATUS FOR CONTROLLING BRIGHTNESS OF DISPLAY IN MOBILE DEVICE

(71) Applicant: Samsung Electronics Co. Ltd., Suwon-si, Gyeonggi-do (KR)

(72) Inventors: Jinsoo Kim, Namyangju-si (KR); Hyungtaek Ryoo, Suwon-si (KR); Seungkoo Jeong, Anyang-si (KR); Eelhyoung Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 168 days.

(21) Appl. No.: 13/735,296

(22) Filed: Jan. 7, 2013

(65) Prior Publication Data

US 2013/0181960 A1 Jul. 18, 2013

(30) Foreign Application Priority Data

Jan. 18, 2012 (KR) ..... 10-2012-0005753

(51) Int. Cl.
*G09G 5/10* (2006.01)

(52) U.S. Cl.
CPC ..... *G09G 5/10* (2013.01); *G09G 2320/062* (2013.01); *G09G 2320/0606* (2013.01); *G09G 2320/08* (2013.01); *G09G 2356/00* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 2008/0122821 | A1* | 5/2008 | Nilsson et al. | 345/207 |
| 2008/0218501 | A1* | 9/2008 | Diamond | 345/207 |
| 2010/0141571 | A1* | 6/2010 | Chiang et al. | 345/102 |
| 2011/0109606 | A1* | 5/2011 | Sagawa | 345/207 |
| 2012/0019493 | A1* | 1/2012 | Barnhoefer et al. | 345/207 |

FOREIGN PATENT DOCUMENTS

JP 2010-34914 A 2/2012

* cited by examiner

*Primary Examiner* — Joseph Haley
*Assistant Examiner* — Emily Frank
(74) *Attorney, Agent, or Firm* — Jefferson IP Law, LLP

(57) ABSTRACT

A method and an apparatus for automatically controlling the brightness of a display unit in a mobile device according to external illuminance are provided. The brightness control method includes measuring a gradient of the mobile device, measuring an external illuminance through at least one of an illuminance sensor and a camera, depending on the measured gradient of the mobile device, and regulating the brightness of the mobile device, based on the measured external illuminance.

20 Claims, 5 Drawing Sheets

METHOD AND APPARATUS FOR CONTROLLING BRIGHTNESS OF DISPLAY IN MOBILE DEVICE

PRIORITY

This application claims the benefit under 35 U.S.C. §119 (a) of a Korean patent application filed on Jan. 18, 2012 in the Korean Intellectual Property Office and assigned Serial No. 10-2012-0005753, the entire disclosure of which is hereby incorporated by reference.

BACKGROUND OF THE INVENTION

1. Field of the Invention

The present invention relates to a method and apparatus for controlling brightness in a mobile device. More particularly, the present invention relates to a method and apparatus for automatically controlling the brightness of a display unit according to external illuminance.

2. Description of the Related Art

With the dramatic advancement in modern scientific techniques, a great variety of mobile devices have been widely popularized. Such mobile devices offer various inherent or optional functions or services such as a call function, a music play function, a short message or multimedia message service, a digital broadcasting service, a short-range wireless communication function, a wireless internet access function, or the like. Accordingly, because mobile devices offer many functions or services, useable time of mobile devices is becoming an important issue.

Meanwhile, recent mobile devices have an increasingly large size of a display unit. The increasingly larger display unit size causes an increase in power consumption of the display unit. Therefore, a technique for reducing power consumption by regulating the brightness of the display unit is required. A mobile device according to the related art measures external illuminance through an illuminance sensor and thereby regulates the brightness of the display unit. However, the illuminance sensor may often fail to detect external illuminance, depending on an angle between the mobile device and a light source. For example, the illuminance sensor can normally detect external illuminance at a right angle between the display unit (e.g., a surface on which the illuminance sensor is equipped) and the light source. However when the mobile device is inclined at a certain angle, the illuminance sensor detects external illuminance as a value smaller than the true external illuminance. In this case, a mobile device according to the related art incorrectly recognizes that external illuminance is reduced even though the external illuminance is not really reduced. Consequently, a mobile device according to the related art improperly reduces the brightness of the display unit.

Therefore, a need exists for a method and apparatus for controlling a brightness of a display unit according to external illuminance.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address the above-mentioned problems and/or disadvantages and to provide at least the advantages described below. Accordingly, an aspect of the present invention is to provide a brightness control method and apparatus which may prevent a mobile device from incorrectly detecting external illuminance at a certain gradient thereof.

Another aspect of the present invention is to provide a brightness control method and apparatus which may allow an automatic brightness regulation based on external illuminance detected through at least one of an illuminance sensor and a camera, depending on the gradient of a mobile device.

According to an aspect of the present invention, a method for controlling brightness in a mobile device is provided. The method includes measuring a gradient of the mobile device, measuring an external illuminance through at least one of an illuminance sensor and a camera, depending on the measured gradient of the mobile device, and regulating the brightness of the mobile device, based on the measured external illuminance.

According to another aspect of the present invention, an apparatus for controlling brightness in a mobile device is provided. The apparatus includes a display unit allowing change in brightness, an illuminance sensor configured to measure illuminance, a camera configured to measure an exposure, a gradient sensor configured to measure a gradient of the mobile device, and a control unit configured to measure external illuminance through at least one of the illuminance sensor and the camera, depending on the measured gradient of the mobile device, and to regulate the brightness of the mobile device, based on the measured external illuminance.

According to another aspect of the present invention, a non-transitory computer readable storage medium is provided. The computer readable storage medium stores instructions that when executed cause at least one processor to perform a method that includes measuring a gradient of the mobile device, measuring an external illuminance through at least one of an illuminance sensor and a camera, depending on the measured gradient of the mobile device, and regulating the brightness of the mobile device, based on the measured external illuminance.

Aspects of the present invention may prevent a mobile device from incorrectly detecting external illuminance at a certain gradient thereof. Namely, selectively using at least one of the illuminance sensor and the camera may allow a good detection of external illuminance even at any gradient of a mobile device. Therefore, when external illuminance is really not reduced, the brightness of the display unit is not unfairly reduced. As a result, aspects of this invention may offer optimum visibility as well as reduced power consumption.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Furthermore, well known or widely used techniques, elements, structures, and processes may not be described or illustrated in detail to avoid obscuring the essence of the present invention. Although the drawings represent exemplary embodiments of the invention, the drawings are not necessarily to scale and certain features may be exaggerated or omitted in order to better illustrate and explain the present invention.

A mobile device is a kind of electronic device that has a plurality of modules. A mobile device may be a mobile communication terminal, a Personal Digital Assistant (PDA), a smart phone, a tablet Personal Computer (PC), a Portable Multimedia Player (PMP), a notebook, and the like.

Figure 1:
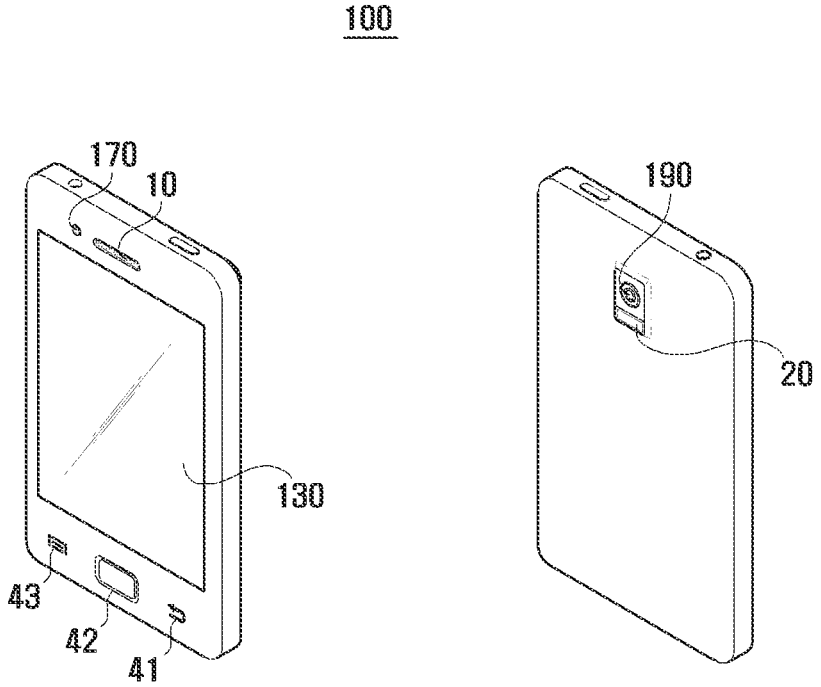
FIG. 1 is a perspective view illustrating a mobile device according to an exemplary embodiment of the present invention.

FIG. 1 is a perspective view illustrating a mobile device according to an exemplary embodiment of the present invention.

Figure 2:
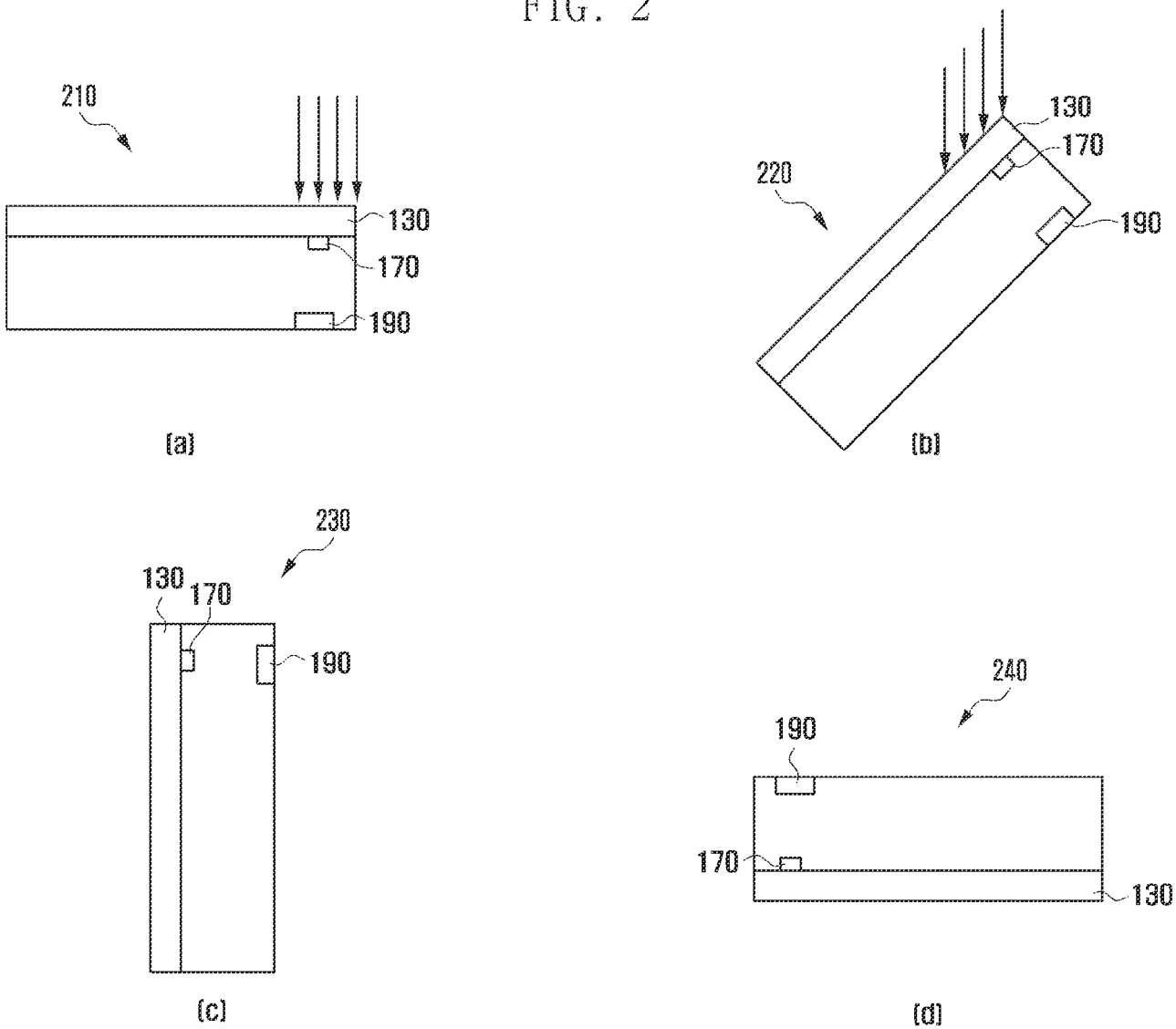
FIG. 2 is a schematic view illustrating variations in illuminance detected by a mobile device, depending on a gradient of the mobile device, according to an exemplary embodiment of the present invention.

FIG. 2 is a schematic view illustrating variations in illuminance detected by a mobile device, depending on a gradient of the mobile device, according to an exemplary embodiment of the present invention.

Referring to FIGS. 1 and 2, a mobile device 100 includes a speaker 10, a Light Emitting Diode (LED) 20, a plurality of function keys 41, 42, and 43, a display unit 130, an illuminance sensor 170, and a camera 190. The body of the mobile device 100 generally has a cubic shape and, at a front side thereof, the display unit 130 is located thereon. The speaker 10 outputs audio signals and is located above the display unit 130. The illuminance sensor 170 can measure external illuminance and may be located to the left of the speaker 10. A plurality of function keys (e.g., a cancel key 41, a home key 42, and a menu key 43) may be located below the display unit 130. The camera 190 may be located at a rear side of the mobile device 100. The LED 20 may be located below the camera 190 in order to offer a flash function. In addition, in the body of the mobile device 100, a gradient sensor (not shown) may be located in order to measure the gradient of the mobile device 100.

The mobile device 100 may regulate the brightness of the display unit 130, depending on variations in external illuminance. For this, a technique according to the related art is to measure external illuminance by using the illuminance sensor 170 and to, based on measurement results, regulate the brightness of the display unit 130. However, in a case in which a light source is the same, namely, even though external illuminance is actually unvaried, the value of external illuminance detected by the illuminance sensor 170 may be varied according to the gradient of the mobile device 100. For example, when the mobile device 100 is perpendicular to incident light rays as indicated by a reference number 210, the illuminance sensor 170 normally detects external illuminance. However, when the mobile device 100 is not perpendicular to incident light rays as indicated by reference numbers 220, 230 and 240, the illuminance sensor 170 fails to normally detect external illuminance. Therefore, exemplary embodiments of the present invention includes the measurement of external illuminance using at least one of the illuminance sensor 170 and the camera 190, based on the gradient of the mobile device 100, and also includes the regulation of brightness of the display unit 130, based on measurement results. Specifically, when a normal detection is possible as indicated by the reference number 210, the mobile device 100 may control the brightness of the display unit 130 in response to external illuminance obtained through the illuminance sensor 170. Under another condition as indicated by the reference number 220 or 230, the mobile device 100 may control the brightness of the display unit 130 in response to external illuminance obtained through a combination of an illuminance value detected by the illuminance sensor 170 and an exposure value of the camera 190. Further, under another condition as indicated by the reference number 240, the mobile device 100 may control the brightness of the display unit 130 in response to external illuminance obtained through an exposure value of the camera 190. According to exemplary embodiments of the present invention, for operation under each of the above conditions, the mobile device 100 may periodically activate the camera 190 to measure an exposure value in a case where a specific range of gradient, for example, gradient ranges in which the illuminance sensor 170 fails to normally measure external illuminance as indicated by the reference numbers 220 to 240. Now, a more detailed description will follow.

Figure 3:
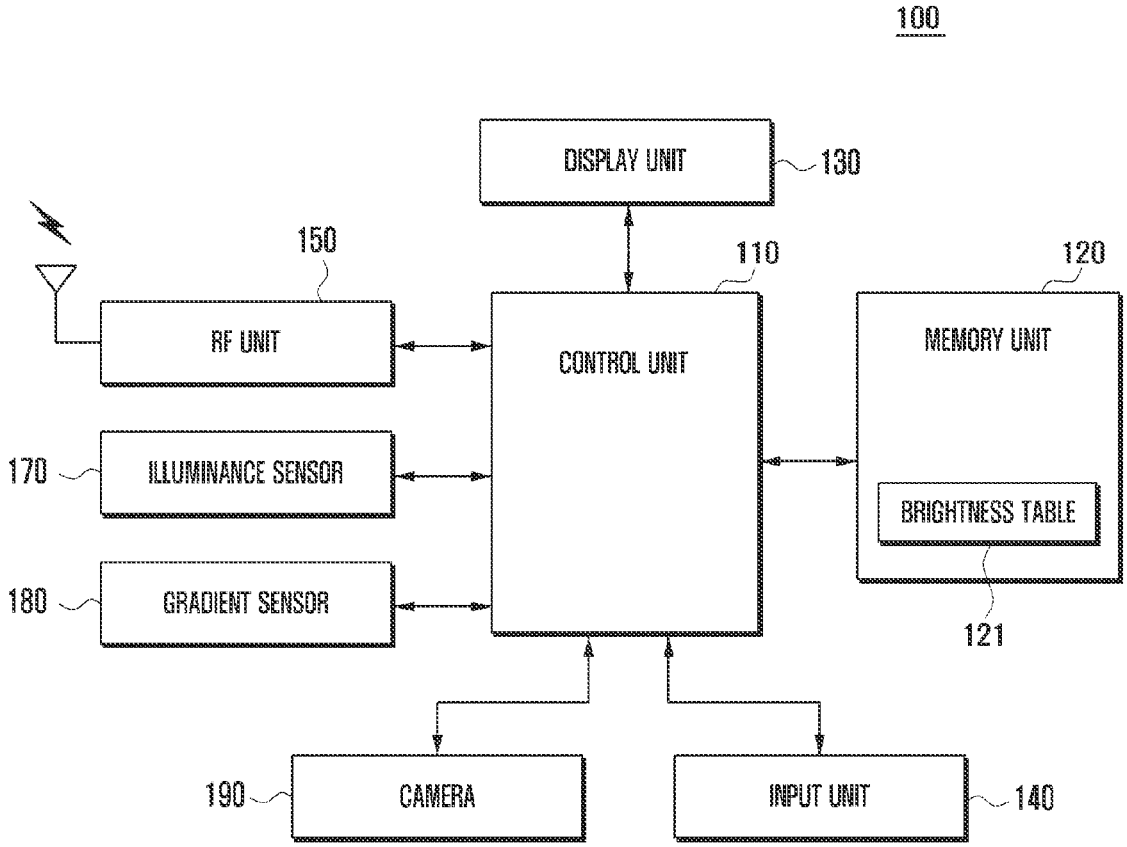
FIG. 3 is a block diagram illustrating a configuration of a mobile device according to an exemplary embodiment of the present invention.
Figure 4:
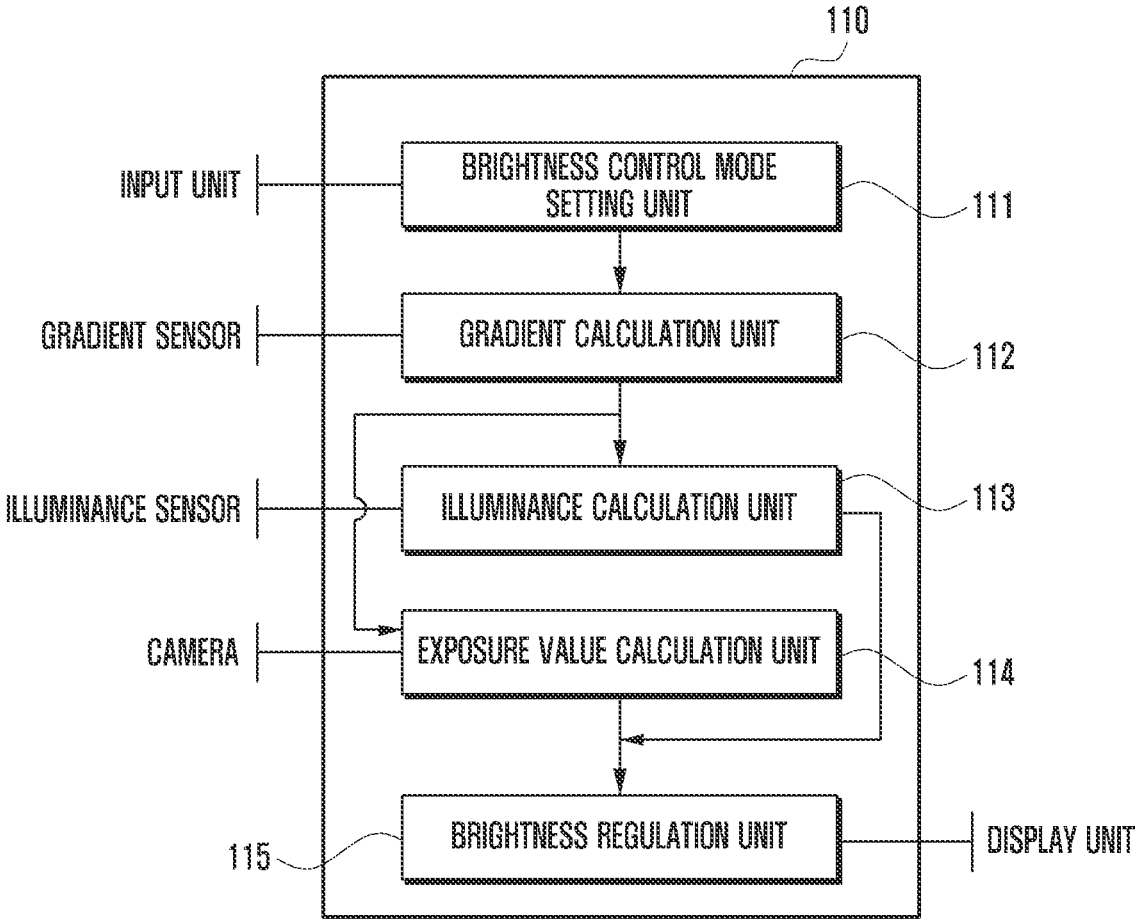
FIG. 4 is a block diagram illustrating a configuration of a control unit such as, for example, the configuration shown in FIG. 3, according to an exemplary embodiment of the present invention.

FIG. 3 is a block diagram illustrating a configuration of a mobile device according to an exemplary embodiment of the present invention. FIG. 4 is a block diagram illustrating a configuration of a control unit, such as, for example, the configuration shown in FIG. 3, according to an exemplary embodiment of the present invention.

Referring to FIGS. 1 to 4, the mobile device 100 may include a control unit 110, a memory unit 120, a display unit 130, an input unit 140, a Radio Frequency (RF) unit 150, an illuminance sensory 170, a gradient sensory 180, and a camera 190. The memory unit 120 may include a brightness table 121. The control unit 110 may include a brightness control mode setting unit 111, a gradient calculation unit 112, an illuminance calculation unit 113, an exposure value calculation unit 114, and a brightness regulation unit 115.

The RF unit 150 may establish a communication channel for a call (including a voice call and a video call) and a data communication channel for data transmission. For this, the RF unit 150 may include an RF transmitter (not shown) that up-converts the frequency of an outgoing signal and then amplifies the signal, an RF receiver (not shown) that amplifies with low-noise an incoming signal and then down-converts the frequency of the signal, and a separator (not shown) that separates the outgoing signal and the incoming signal. If the mobile device 100 offers no RF function, then the RF unit 150 may be removed.

The input unit 140 may include a plurality of input keys and function keys that create input signals for entering numerical or literal information, and for setting or controlling various functions of the mobile device 100. For example, the input unit 140 sends such input signals to the control unit 110. Particularly, the input unit 140 may transmit to the control unit 110 input signals for selecting the on/off states of an automatic brightness control mode that automatically regulates the brightness of the display unit 130 depending on external illuminance. As an example, the input unit 140 may be formed of one or a combination of a button-type keypad, a ball joystick, an optical joystick, a wheel key, a touch key, a touch pad, a touch screen, and the like.

The display unit 130 represents information, including various menus of the mobile device 100, inputted by a user or offered to a user. For example, the display unit 130 may visually offer a variety of screen views in connection with the use of the mobile device 100, such as an idle screen (e.g., referred to as a home screen), a menu screen, a message writing screen, a call screen, a scheduler screen, a phonebook screen, a web page display screen, and the like. As an example, the display unit 130 may have a different brightness depending on external illuminance detected through at least one of the illuminance sensor 170 and the camera 190 under the control of the control unit 110. For example, the control unit 110 may operatively control the display unit 130 so as to change the brightness based on the external illuminance detected through at least one of the illuminance sensor 170 and the camera 190. The display unit 130 may be formed of a Liquid Crystal Display (LCD), an Organic Light Emitting Diodes (OLED), an Active Matrix OLED (AMOLED), or any other equivalent. If the display unit 130 is formed of a touch screen, the display unit 130 may also act as the input unit 140.

The gradient sensor 180 may detect gradient information of the mobile device 100. For example, the gradient sensor 180 may be activated in an automatic brightness control mode and transmit information about gradient variations of the mobile device 100 to the control unit 110. According to exemplary embodiments of the present invention, the gradient sensor 180 may be formed of one or combination of a gyroscope sensor, a tilt sensor, an acceleration sensor, a geomagnetic sensor, a gravity sensor, and the like.

The camera 190 is a device that captures a still image or records a video and then converts optical images into electric signals. As an example, the camera 190 may be a Complementary Metal Oxide Semiconductor (CMOS) type or a Charge Coupled Device (CCD) type. Because the camera 190 is well known in the art, a detailed description will be omitted herein. According to exemplary embodiments of the present invention, the camera 190 may be activated and may measure an exposure value when an automatic brightness control mode is in the on-state and also when the gradient of the mobile device 100 falls within a specific range. For example, the camera 190 may measure external illuminance by periodically obtaining an exposure value under the control of the control unit 110. For this, the camera 190 may include a means for measuring an exposure value. Because this technique is well understood by those skilled in the art, a detailed description will be omitted herein.

The illuminance sensor 170 is a device that measures external illuminance, and may be activated in an automatic brightness control mode. The illuminance sensor 170 may be a kind of optical sensor that has a photo-sensing device such as a transistor or a photodiode. This photo-sensing device may have varying resistance according to the amount of light. For example, the illuminance sensor 170 may detect external illuminance through variations in resistance. Because the illuminance sensor 170 is well understood by those skilled in the art, a detailed description will be omitted herein.

The memory unit 120 may store programs and data required for operations of the mobile device 100, including an Operating System (OS), applications associated with various optional functions such as a sound reproduction, an image or video playback, a broadcasting reception, or the like, various related user data, and transmitted or received data in communications. For example, the memory unit 120 may store video files, game files, music files, movie files, and the like. According to exemplary embodiments of the present invention, the memory unit 120 may store an automatic brightness control application that controls the brightness of the display unit 130 according to external illuminance. The automatic brightness control application may include a routine for selecting the on/off states of an automatic brightness control mode, a routine for detecting variations in gradient of the mobile device 100 in the automatic brightness control mode, a routine for measuring external illuminance through at least one of the illuminance sensor 170 and the camera 190 on the basis of gradient variations of the mobile device 100, and a routine for regulating the brightness of the display unit 130 in response to the measured external illuminance. Also, the routine for measuring external illuminance may include a subroutine for calculating external illuminance through the illuminance sensor 170, a subroutine for calculating external illuminance through an exposure value of the camera 190, and a subroutine for calculating external illuminance through a combination of illuminance and exposure values.

Additionally, the memory unit 120 may store the range of gradient. For example, the range of gradient may be classified into three ranges according to states of the illuminance sensor 170 and the camera 190. For example, the first gradient range may be defined as angles between 0 and 20 degrees in which the illuminance sensor 170 only is activated. As another example, the second gradient range may be defined as angles between 20 and 160 degrees in which both the illuminance sensor 170 and the camera 190 are activated. As a further example, the third gradient range may be defined as angles between 160 and 180 degrees in which the camera 190 only is activated. On the assumption that the mobile device rotates a full 360 degrees, the first gradient range may further cover angles between 340 and 360 degrees, the second gradient range may further cover angles between 200 and 340 degrees, and the third gradient range may further cover angles between 180 and 200 degrees. In addition, the second gradient range may be divided into several stages, for example, but not limited to, four stages such as angles between 20 and 50 degrees, between 50 and 90 degrees, between 90 and 120 degrees, and between 120 and 160 degrees. Depending on designer's intention, the second gradient range may be divided variously into two or more stages.

As shown in Table 1 below, the memory unit 120 may store a brightness table 121 in which the brightness is mapped with illuminance and exposure.

TABLE 1

| Brightness (cd/m$^2$) | Outdoor II(300) | Outdoor I(220) | Indoor II(160) | Indoor I(110) | Night (40) |
|---|---|---|---|---|---|
| Illuminance (lux) | 980 or more | 860 or more less than 980 | 740 or more less than 860 | 620 or more less than 740 | less than 620 |
| Exposure | 580 or more | 490 or more less than 580 | 400 or more less than 490 | 310 or more less than 400 | less than 310 |

Referring to the brightness table 121 shown in Table 1, the brightness of the display unit 130 may be regulated by five stages according to illuminance or exposure. However, this is exemplary only and not to be considered as a limitation of the exemplary embodiments of the present invention. The number of stages for regulating the brightness of the display unit 130 may be varied according to designer's intention. In Table 1, illuminance values are applied to cases in which the mobile device 100 is within the first gradient range, and exposure values are applied to cases in which the mobile device 100 is within the third gradient range. For example, the brightness of the display unit 130 is regulated according to external illuminance when the mobile device 100 has a gradient angle within the first gradient range, and also is regulated according to the exposure of the camera 190 when the mobile device 100 has a gradient angle within the third gradient range.

Additionally, as shown in Table 2 below, the brightness table 121 stored in the memory unit 120 may define the brightness based on a combination of gradient, illuminance and exposure.

TABLE 2

| Brightness (cd/m$^2$) | | Outdoor II(300) | Outdoor I(220) | Indoor II(160) | Indoor I(110) | Night (40) |
|---|---|---|---|---|---|---|
| Gradient (20~50 degrees) | illuminance | 800~ | 680~800 | 560~680 | 440~560 | ~440 |
| | exposure | 330~ | 300~330 | 270~300 | 240~270 | ~240 |
| Gradient (50~90 degrees) | illuminance | 750~ | 630~750 | 510~630 | 390~510 | ~390 |
| | exposure | 380~ | 350~380 | 320~350 | 290~320 | ~290 |
| Gradient (90~120 degrees) | illuminance | 700~ | 580~700 | 460~580 | 340~460 | ~340 |
| | exposure | 430~ | 400~430 | 370~400 | 340~370 | ~340 |
| Gradient (120~160 degrees) | illuminance | 650~ | 530~650 | 410~530 | 290~410 | ~290 |
| | exposure | 480~ | 450~480 | 420~450 | 390~420 | ~390 |

Referring to Table 2, the second gradient range is divided into four stages, each of which defines the brightness of the display unit 130 mapped with a combination of illuminance and exposure. For example, when the mobile device 100 has a gradient angle within the second gradient range, the brightness of the display unit 130 may be regulated according to a combination of illuminance and exposure. For example, if the mobile device 100 has a gradient angle of 95 degree, and if illuminance and exposure are 600 and 410, respectively, the brightness of the display unit 1300 may be regulated to 220 corresponding to outdoor I case. Also, if the mobile device 100 has a gradient angle of 130 degree, and if illuminance and exposure are 300 and 400, respectively, the brightness of the display unit 1300 may be regulated to 110 corresponding to indoor I case.

Although Table 2 shows four stages of the second gradient range, this is exemplary only and not to be considered as a limitation of the exemplary embodiments of the present invention. The second gradient range may be divided into different stages, depending on designer's intention. Similarly, values stated in Tables 1 and 2 are exemplary only and not to be considered as a limitation of the exemplary embodiments of the present invention. These brightness tables may be optimized by means of experiments.

Meanwhile, the control for the brightness of the display unit 130 is not limited to using brightness tables. For example, when the mobile device 100 has the second gradient range, the memory unit 120 may store calculation equations for converting a combination of illuminance and exposure values into external illuminance in the first gradient range. For example, a calculation equation may assume the form in which the product of illuminance and first predetermined weight is added to the product of exposure and second predetermined weight. If the second gradient range is divided into several stages, different calculation equations may be assigned to such stages. For example, first and second weights may be varied according to stages and also be optimized by means of experiments.

The control unit 110 may control the whole operation of the mobile device 100 and signal flows between internal blocks of the mobile device 100, and perform a data processing function. Particularly, the control unit 110 may check whether an automatic brightness control mode is in the on-state, detect the gradient of the mobile device 100 in the automatic brightness control mode, measure external illuminance through at least one of the illuminance sensor 170 and the camera 190 on the basis of the gradient of the mobile device 100, and regulate the brightness of the display unit 130 according to external illuminance. For this, the control unit 110 may include a brightness control mode setting unit 111, a gradient calculation unit 112, an illuminance calculation unit 113, an exposure value calculation unit 114, and a brightness regulation unit 115.

The brightness control mode setting unit 111 may set the on/off states of the automatic brightness control mode for automatically controlling the brightness of the display unit 130, depending on input signals from the input unit 140. If the automatic brightness control mode is in the on state, the gradient calculation unit 112 may periodically calculate the gradient of the mobile device 100 through the gradient sensor 180. Further, depending on the gradient, the gradient calculation unit 112 may request to the control unit 110 to activate at least one of the illuminance calculation unit 113 and the exposure value calculation unit 114.

The illuminance calculation unit 113 may calculate external illuminance through the illuminance sensor 170. Specifically, the illuminance calculation unit 113 may be activated when the mobile device 100 has a gradient angle within the first or second gradient range, and deliver a calculated illuminance value to the brightness regulation unit 115. The exposure value calculation unit 114 may calculate an exposure value of the camera 190. Specifically, the exposure value calculation unit 114 may be activated when the mobile device 100 has a gradient angle within the second or third gradient range, and deliver a calculated exposure value to the brightness regulation unit 115.

Depending on a gradient value obtained through the gradient calculation unit 112, the brightness regulation unit 115 may regulate the brightness of the display unit 130 according to illuminance and/or exposure values obtained through at least one of the illuminance calculation unit 113 and the exposure value calculation unit 114. For example, the brightness regulation unit 115 may regulate the brightness of the display unit 130 by controlling current or voltage supplied for driving the display unit 130. Because this technique is well known in the art, a detailed description will be omitted herein. Meanwhile, when the automatic brightness control mode is in the off state, the brightness regulation unit 115 may maintain the brightness of the display unit 130 as a specific brightness set by user's input through the input unit 140.

Although in the above exemplary embodiment of the present invention, the control unit 110 measures periodically the gradient of the mobile device 100, this is exemplary only and not to be considered as a limitation of the exemplary embodiments of the present invention. Alternatively, the control unit 110 may measure the gradient of the mobile device 100 only when there is a request for change in brightness of the display unit 130. This is for reducing power consumption caused by frequent driving of the gradient sensor 180, the illuminance sensor 170 and the camera 190.

Although not illustrated in FIG. 3, according to exemplary embodiments of the present invention, the mobile device 100 may essentially or selectively include any other elements such as a Global Positioning System (GPS) module, a broadcast receiving module, a digital sound play module such as a Moving Picture Experts Group (MPEG)-1 or MPEG-2 Audio Layer 3 (MP3) module, an internet access module, and the like. According to a digital convergence tendency today, such elements may be varied, modified and improved in various ways, and any other elements equivalent to the above elements may be additionally or alternatively equipped in the mobile device 100. As will be understood by those skilled in the art, some of the above-mentioned elements in the mobile device may be omitted or replaced with another.

Figure 5:
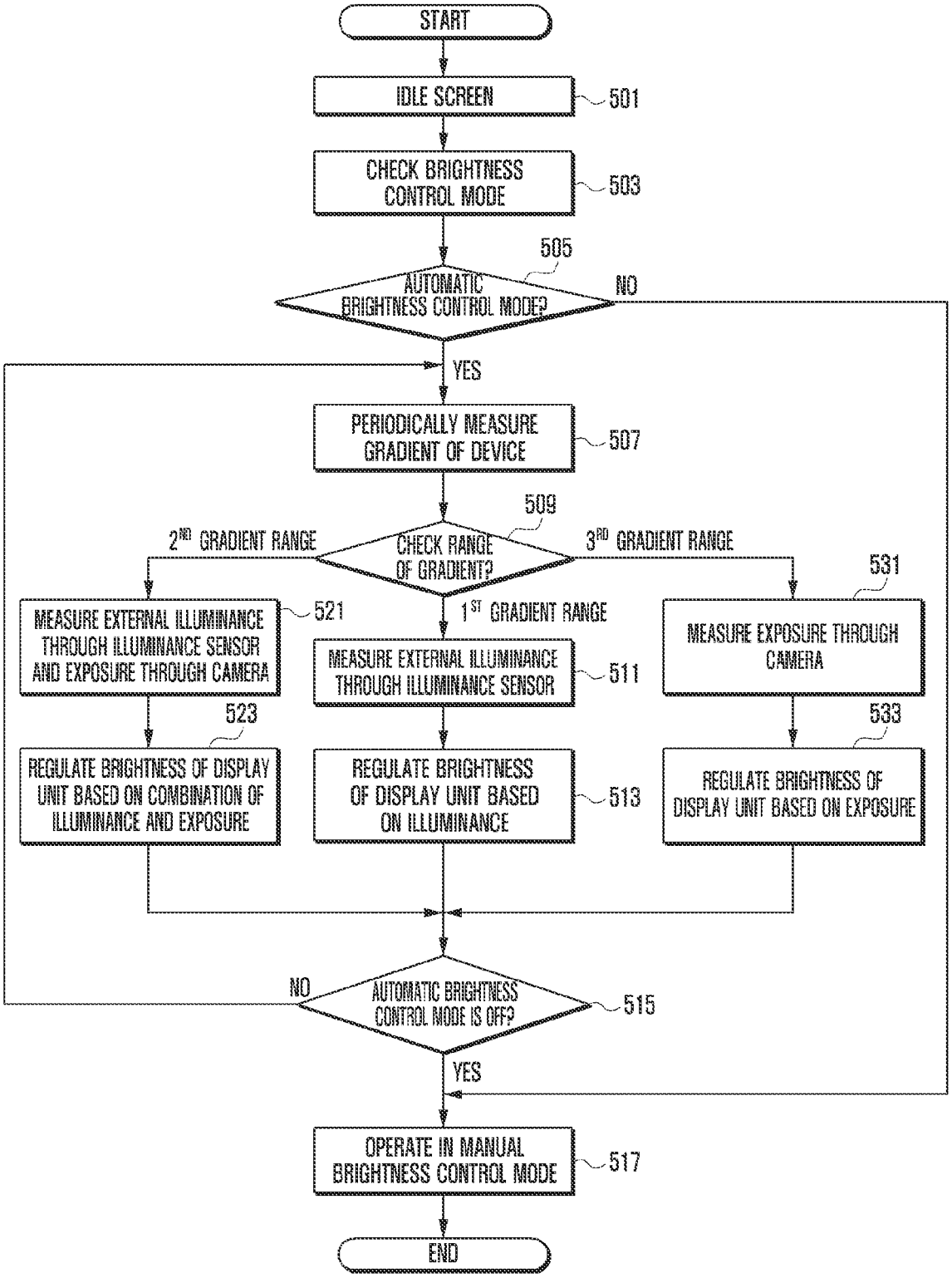
FIG. 5 is a flow diagram illustrating a brightness control method of a mobile device according to an exemplary embodiment of the present invention.

FIG. 5 is a flow diagram illustrating a brightness control method of a mobile device according to an exemplary embodiment of the present invention.

Referring to FIGS. 1 to 5, the control unit 110 may initialize each element of the mobile device 100 when electric power is supplied. After initialization, the control unit 110 may output an idle screen at step 501. Next, the control unit 110 may check a brightness control mode at step 503 and then determine whether a current mode is an automatic brightness control mode at step 505. If a current mode of the mobile device 100 is not an automatic brightness control mode, for example, if the mobile device 100 is currently in a manual brightness control mode, then the control unit 110 may perform step 517 to be described later. In contrast, if a current mode of the mobile device 100 is an automatic brightness control mode, then the control unit 110 may perform step 507 to measure the gradient of the mobile device on a specific cycle (e.g., the first period). For this, the mobile device 100 may use the gradient sensor 180.

The control unit 110 may check the range of gradient of the mobile device 100 at step 509. As an example, the range of gradient may be classified into three ranges according to states of the illuminance sensor 170 and the camera 190. Specifically, as an example, the first gradient range may be defined as angles between 0 and 20 degrees in which the illuminance sensor 170 only is activated. As another example, the second gradient range may be defined as angles between 20 and 160 degrees in which both the illuminance sensor 170 and the camera 190 are activated. As a further example, the third gradient range may be defined as angles between 160 and 180 degrees in which the camera 190 only is activated. On the assumption that the mobile device rotates a full 360 degrees, the first gradient range may further cover angles between 340 and 360 degrees, the second gradient range may further cover angles between 200 and 340 degrees, and the third gradient range may further cover angles between 180 and 200 degrees. In addition, the second gradient range may be divided into several stages, for example, but not limited to, four stages such as angles between 20 and 50 degrees, between 50 and 90 degrees, between 90 and 120 degrees, and between 120 and 160 degrees. Depending on a designer's intention, the second gradient range may be divided variously into two or more stages.

In a case of the first gradient range as the result of check, the control unit 110 may perform step 511 to measure external illuminance through the illuminance sensor 170 on a specific cycle (the second period). Then the control unit 110 may regulate the brightness of the display unit 130, based on a measured illuminance value at step 513. For this, the control unit 110 may search the brightness table 121 in which the brightness of the display unit 130 is mapped with external illuminance (e.g., values sorted by ranges).

In a case of the second gradient range as the result of check, the control unit 110 may perform step 521 to measure an exposure value and an illuminance value through the camera 190 and the illuminance sensor 170 on a specific cycle (e.g., the third period). Then the control unit 110 may regulate the brightness of the display unit 130, based on a combination of measured exposure and illuminance values at step 523. For example, the control unit 110 may regulate the brightness of the display unit 130 by referring to the brightness table 121, shown in Table 2, in which the brightness is mapped with a combination of a gradient, an exposure value, and an illuminance value. According to exemplary embodiments of the present invention, the brightness table 121 may be optimized by means of experiments.

In a case of the third gradient range as the result of check, the control unit 110 may perform step 531 to measure an exposure value of the camera 190 on a specific cycle (e.g., the fourth period). Then the control unit 110 may regulate the brightness of the display unit 130, based on a measured exposure value at step 533. For this, the control unit 110 may search the brightness table 121 in which the brightness of the display unit 130 is mapped with an exposure value (e.g., values sorted by ranges) of the camera 190.

Thereafter, the control unit 110 may determine whether the automatic brightness control mode is in the off state at step 515. If the automatic brightness control mode is not in the off state, the control unit 110 may return to the above-discussed step 507. If the automatic brightness control mode is in the off state, the control unit 110 may perform step 517 to operate in a manual brightness control mode in which the brightness of the display unit 130 is maintained as a specific brightness set by a user.

Meanwhile, the first, second, third and fourth periods may have different values from each other, or some of them may have the same value. Additionally, when the mobile device 100 has the second gradient range, a brightness control for the display unit 130 does not always use the brightness table 121 that defines mapping relations among gradient, illuminance and exposure. Alternatively, by using a predetermined calculation equation, exposure and illuminance values measured in the second gradient range may be converted into an illuminance value in the first gradient range. Therefore, the brightness of the display unit 130 may be regulated referring to Table 1. If the second gradient range is divided into several stages, different calculation equations may be assigned to such stages. For example, the memory unit 120 may store four calculation equations when the second gradient range has four stages.

Although in the above exemplary embodiment of the present invention the control unit 110 periodically measures the gradient of the mobile device 100, this is exemplary only and not to be considered as a limitation of the exemplary embodiments of the present invention. Alternatively, the control unit 110 may measure the gradient of the mobile device 100 only when there is a request for change in brightness of the display unit 130. This is for reducing power consumption caused by frequent driving of the gradient sensor 180, the illuminance sensor 170 and the camera 190.

It will be understood that the above-discussed brightness control method in the mobile device can be implemented by computer program instructions. These computer program instructions can be provided to a processor of a general purpose computer, special purpose computer, or other programmable data processing apparatus to produce a machine, such that the instructions, which are executed via the processor of the computer or other programmable data processing apparatus, create means for implementing the functions specified in the flowchart block or blocks. These computer program instructions may also be stored in a non-transitory computer readable storage medium that can direct a computer or other programmable data processing apparatus to function in a particular manner, such that the instructions stored in the non-transitory computer readable storage medium produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that are executed on the computer or other programmable apparatus provide steps for implementing the functions specified in the flowchart block or blocks. And each block of the flowchart illustrations may represent a module, segment, or portion of code, which comprises one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

While this invention has been particularly shown and described with reference to an exemplary embodiment thereof, it will be understood by those skilled in the art that various changes in form and details may be made therein without departing from the spirit and scope of the invention as defined by the appended claims and their equivalents.

What is claimed is:

1. A method for controlling brightness in a mobile device, the method comprising:

measuring a gradient of the mobile device;

determining a range of the measured gradient of the mobile device;

measuring an external illuminance through at least one of an illuminance sensor and a camera, according to the determined range of the measured gradient of the mobile device; and regulating the brightness of a display unit of the mobile device, based on the measured external illuminance.

2. The method of claim 1, wherein the measuring of the external illuminance includes:

measuring the external illuminance through the illuminance sensor when the measured gradient of the mobile device is in a predefined first gradient range;

measuring the external illuminance through a combination of the illuminance sensor and the camera when the measured gradient of the mobile device is in a predefined second gradient range; and measuring the external illuminance through the camera when the measured gradient of the mobile device is in a predefined third gradient range.

3. The method of claim 2, wherein the measuring of the external illuminance through a combination of the illuminance sensor and the camera includes searching a brightness table in which a brightness value of the mobile device is mapped with a combination of an illuminance value measured through the illuminance sensor and an exposure value measured through the camera.

4. The method of claim 3, wherein the second gradient range includes two or more stages.

5. The method of claim 4, wherein the brightness table includes mapping relations among the brightness values, the illuminance values, and the exposure values for each stage of the second gradient range.

6. The method of claim 1, wherein the measuring of the gradient of the mobile device is performed periodically or when there is a request for change in brightness.

7. An apparatus for controlling brightness in a mobile device, the apparatus comprising:

a display unit allowing change in brightness;

an illuminance sensor configured to measure illuminance;

a camera configured to measure an exposure;

a gradient sensor configured to measure a gradient of the mobile device; and a control unit configured to determine a range of the measured gradient of the mobile device, measure external illuminance through at least one of the illuminance sensor and the camera, according to the determined range of the measured gradient of the mobile device, and to regulate the brightness of the display unit, based on the measured external illuminance.

8. The apparatus of claim 7, wherein the control unit is further configured to measure the external illuminance through the illuminance sensor when the measured gradient of the mobile device is in a predefined first gradient range, to measure the external illuminance through a combination of the illuminance sensor and the camera when the measured gradient of the mobile device is in a predefined second gradient range, and to measure the external illuminance through the camera when the measured gradient of the mobile device is in a predefined third gradient range.

9. The apparatus of claim 8, further comprising:

a memory unit configured to store a brightness table in which a brightness value of the mobile device is mapped with at least one of an illuminance value measured through the illuminance sensor and an exposure value measured through the camera.

10. The apparatus of claim 9, wherein the control unit is further configured to regulate the brightness of the display unit by the brightness value mapped with the illuminance value measured through the illuminance sensor when the measured gradient of the mobile device is in the first gradient range.

11. The apparatus of claim 9, wherein the control unit is further configured to regulate the brightness of the display unit by the brightness value mapped with a combination of the illuminance value measured through the illuminance sensor and the exposure value measured through the camera when the measured gradient of the mobile device is in the second gradient range.

12. The apparatus of claim 11, wherein the second gradient range includes two or more stages.

13. The apparatus of claim 12, wherein the brightness table includes mapping relations between the brightness value and the combination of the illuminance value and the exposure value for each stage of the second gradient range.

14. The apparatus of claim 9, wherein the control unit is further configured to regulate the brightness of the display unit by the brightness value mapped with the exposure value measured through the camera when the measured gradient of the mobile device is in the third gradient range.

15. The apparatus of claim 7, wherein the control unit is further configured to measure the gradient of the mobile device periodically or when there is a request for change in brightness.

16. The apparatus of claim 7, wherein the camera and the illuminance sensor are located at opposite sides of a body of the mobile device.

17. The apparatus of claim 7, further comprising:

an input unit configured to create input signals for selecting the on/off states of an automatic brightness control mode that automatically regulates the brightness of the display unit, depending on the external illuminance measured through at least one of the illuminance sensor and the camera and the gradient of the mobile device.

18. A non-transitory computer readable storage medium storing instructions that when executed cause at least one process to perform a method including:

measuring a gradient of the mobile device;

determining a range of the measured gradient of the mobile device;

measuring an external illuminance through at least one of an illuminance sensor and a camera, according to the determined range of the measured gradient of the mobile device; and regulating a brightness of a display unit of the mobile device, based on the measured external illuminance.

19. The computer readable storage medium of claim 18, wherein the instructions are configured such that the measuring of the external illuminance includes:

measuring the external illuminance through the illuminance sensor when the measured gradient of the mobile device is in a predefined first gradient range;

measuring the external illuminance through a combination of the illuminance sensor and the camera when the measured gradient of the mobile device is in a predefined second gradient range; and measuring the external illuminance through the camera when the measured gradient of the mobile device is in a predefined third gradient range.

20. The computer readable storage medium of claim 19, wherein the instructions are configured such that the measuring of the external illuminance through a combination of the illuminance sensor and the camera includes searching a brightness table in which a brightness value of the mobile device is mapped with a combination of an illuminance value measured through the illuminance sensor and an exposure value measured through the camera.

* * * * *